United States Patent [19]

Koregelos

[11] 4,114,504

[45] Sep. 19, 1978

[54] DEMOISTURIZER FOR WIND MUSICAL INSTRUMENTS

[76] Inventor: George Koregelos, 470 Mountain Ave., Piedmont, Calif. 94611

[21] Appl. No.: 818,553

[22] Filed: Jul. 25, 1977

[51] Int. Cl.[2] ..... G10G 7/00

[52] U.S. Cl. ..... 84/453; 15/104.2; 15/164; 15/206; 15/210 R; 84/380 R

[58] Field of Search ..... 15/104.16, 104.2, 164, 15/206, 210 R; 84/330, 380, 381, 382, 384, 385 R, 386, 397, 453

[56] References Cited

U.S. PATENT DOCUMENTS

| | | | |
|---|---|---|---|
| 1,650,004 | 11/1927 | Billings | 84/453 |
| 1,730,785 | 10/1929 | Romao | 84/385 X |
| 2,339,123 | 1/1944 | Volckening | 15/164 |
| 3,151,517 | 10/1964 | Guinness | 84/330 |
| 3,488,790 | 1/1970 | Satoh | 84/453 |

*Primary Examiner*—Lawrence R. Franklin
*Attorney, Agent, or Firm*—James R. Cypher

[57] ABSTRACT

An elongated member dimensioned for receipt within a wind instrument for removing moisture from the valve pads and inside walls of the instrument including a base, filament members extending from the base to the wall and valve pads of the instrument. The filaments either absorb, moisture or absorb moisture from the walls and pads. A cotton strip may be included to hold the moisture collected by the filaments.

9 Claims, 6 Drawing Figures

DEMOISTURIZER FOR WIND MUSICAL INSTRUMENTS

BACKGROUND OF THE INVENTION

After playing a wind instrument, such as a flute, clarinet, saxophone, oboe, bassoon or the like, proper care requires that the inside walls be swabbed to remove the moisture which has condensed from the instrumentalists breath. While the usual cotton swab can perform reasonably in drying the inside walls of the instrument, it is practically impossible to remove any moisture from the valve pads by such a procedure. Valve pads are generally made from leather, felt, gut, or cork and failure to remove excess moisture causes them to swell, warp, or crack. Leaking problems develop; the tone is distorted, and the pads must be replaced. Although hundreds of thousands of musicians have played wind instruments for several hundred years, not one of them has presented a device such as the one described in this application to solve the problem of sticking valves and pad problems caused by a failure to remove the excess moisture from the pads.

SUMMARY OF THE INVENTION

The main purpose of the present invention is to provide a device which can be inserted into a wind instrument after it has been played; permitted to remain within the instrument until it is again played, and will remove substantially all of the excess moisture from the valve pads.

The gist of the present device is the use of a plurality of filaments which are held in contact with the valve pads and either adsorb or absorb the moisture or both. In the preferred form of the invention, a strip of cotton in contact with the fibers serves as a moisture reservoir for water withdrawn from the pads.

The device dries either within the instrument due to air circulation through the open valve ports when the instrument is not within a case, or the device dries when it is removed from the instrument while the instrument is being played.

Another purpose of the device is to prevent warping, deterioration and sticking of the pads of a wind instrument.

DESCRIPTION OF THE PREFERRED EMBODIMENTS OF THE INVENTION

Figure 1:
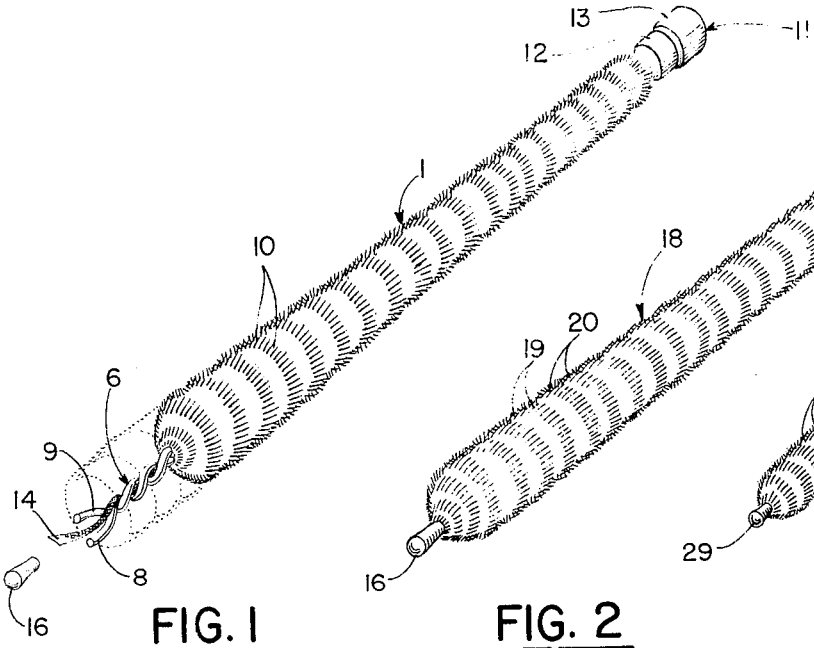
FIG. 1 is a perspective view of the device of the present invention dimensioned for use with an alto saxophone. The filaments from one end have been removed to reveal the structure of the device.
Figure 6:
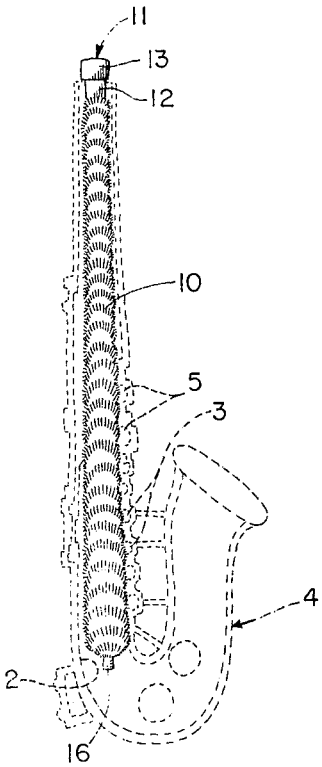
FIG. 6 illustrates the use of the device of FIG. 1 with an alto saxophone shown in broken line.

FIGS. 1 and 6 illustrate one form of demoisturizing device 1 for removing excess moisture from the inside wall 2 and valve pads 3 of an alto saxophone 4 having valve openings 5. The device consists briefly of an elongated semi-rigid member 6 having a length selected to span a substantial portion of the sectional length of the instrument. The member may be a length of wood, plastic or other material with some flexibility or a pair of twisted wires 8 and 9 as illustrated. A plurality of filaments 10 are attached to the semi-rigid members and extend outwardly therefrom. As illustrated, the filaments may be intertwined with the twisted wires or connected by other means. The important point is that the length of the filaments is selected so that they will touch the inside walls of the instrument when the device is inserted, and the ends of the filaments will actually penetrate through the valve openings 5 and touch the valve pads 3 on the instrument keys.

Since the device is intended to remain within the instrument for extended periods of time, it is preferable that a cap 11 be attached to the end of the device. This cap may be a simple tapered member or it may be formed with a reduced neck portion 12 to register securely with the inside walls of the instrument and an enlarged head portion 13 for ease in grasping and withdrawing the device. The cap may be made from rubber, plastic, cork, wood or the like.

The filaments may be made from various materials. Filaments made from synthetic materials such as nylon have the desirable characteristic that the filaments remain fairly rigid and remain in contact with the pads. The ability to remove moisture, however, is limited since moisture is withdrawn from the pads only by absorption. All cotton filaments are excellent for adsorbing and absorbing moisture from the pads, but the filaments are not stiff enough to retain their shape in contact with the walls and pads. A recently developed filament by E. I. Du Pont de Nemours & Co., (inc.) of Wilmington, Delaware bearing the trademark Antron has proved to be far superior to Nylon. Antron is a bulked continuous filament which is normally used as a carpet fiber. The important characteristics of Antron when used in a demoisturizing device is the fact that voids run lengthwise through each individual filament which enables them to withdraw moisture from the pads by the process of absorption.

It has been found, however, that a blend of Antron and cotton fibers is the preferred form of the invention. The Antron fibers are capable of withdrawing moisture by adsorption and absorption and they also have the ability to maintain the ends of the filaments in contact with the walls and pads. The cotton filaments are supported by the Antron filaments in contact with the walls and pads, and of course, the cotton filaments have the best moisture absorbing qualities. The particular blend of Antron and cotton fibers is not critical. It has been found, however, that a 60 percent cotton and 40 percent Antron content works very satisfactorily. The cotton filament may be a 40 - 1 cotton yarn.

An important feature of the present invention in improving the demoisturizing characteristics of the device is the use of an elongated strip 14 of moisture absorbent material connected to the elongated member and operatively connected to the filaments. Such material may be paper or cloth. An inexpensive and effective material is a strip of cotton cloth. As illustrated in FIG. 1, where a pair of twisted wires are used, the absorbent cotton cloth may be twisted with the wires at the same time the wires are twisted. The absorbent cotton must of course be in touching contact with the filaments. The cotton member, filament, and wires may all be twisted together at one time in the manufacture of the device.

A saxophone has a tapered shape; becoming wider as it extends toward the bell. The device, therefore should have a tapered shape as illustrated in FIGS. 1 and 6. As shown in FIG. 1, the device should carry a protector cap 16 at the distal end to protect the inside of the instrument from abrasions. The cap may be of rubber, plastic or other suitable soft materials.

Figure 2:
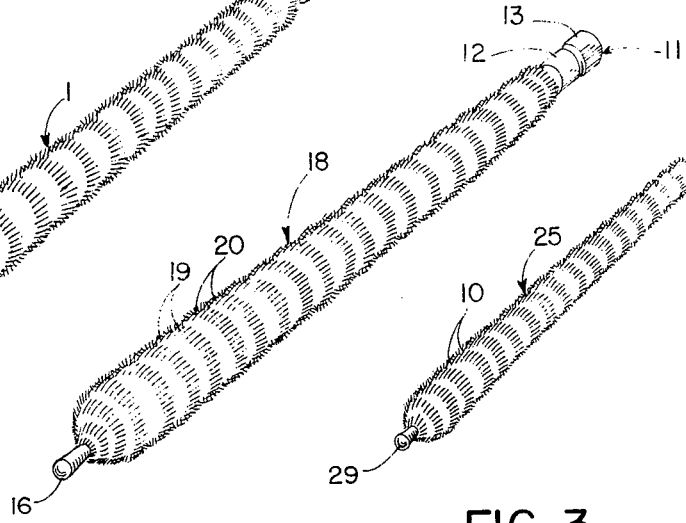
FIG. 2 is a perspective view of the device of the present invention dimensioned for use with a soprano saxophone.

Referring to FIG. 2, an alternate form of the invention is shown. For purposes of brevity, like parts are given identical numbers. Device 18 is somewhat smaller and is specially made for a soprano saxophone. The other difference is the fact that it illustrates the device with both cotton filaments 19 and Antron filaments 20. It is to be understood that any of the devices illustrated could be made with both Antron and cotton filaments. Also the Soprano saxophone device illustrated could be made from all Antron, all nylon, or all cotton filaments. Where made from a blend of different fibers, distribution should be as even as possible.

Figure 5:
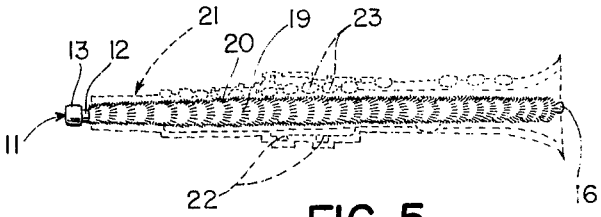
FIG. 5 is an illustration of the device with a soprano saxophone shown in broken line.

FIG. 5 illustrates the placement of the device of FIG. 2 within a soprano saxophone 21. Note that the filaments are dimensioned to protrude through the valve openings 22 and to touch the valve pads 23.

Figure 3:
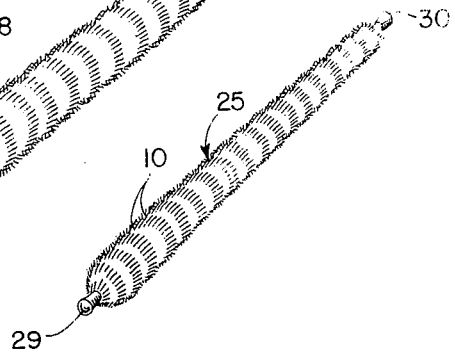
FIG. 3 is a perspective view of the device of the present invention dimensioned for use with a flute.
Figure 4:
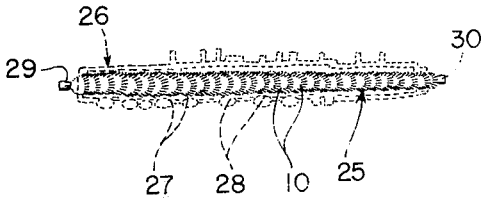
FIG. 4 is a side view of the device of FIG. 3. A flute is illustrated in broken line showing the use of the device.

FIGS. 3 and 4 illustrate still another form of the invention. Here, the device 25 is dimensioned for placement in the body section of a flute 26. The device is constructed identical to the previous devices except for some minor differences. For purposes of brevity, the like parts are given identical numbers. The device may be constructed with a constant cross section since the body of a flute is substantially a straight constant diameter tube. The filaments 10, as before, are dimensioned to protrude through the valve openings 27 and touch the pads 28 of the keys. It is not necessary to provide a cap on the flute device because the device is small and may extend all the way through the body of the flute. It is only necessary to provide protection caps 29 and 30 on both ends.

The operation of the device is as follows. After playing the instrument, the instrumentalist may wish to drain any excess water from the instrument in the usual manner. He may also wish to swab the inside of the device with the standard cotton swabs. In most instances, however, it is only necessary to drain the instrument and then place the device described inside the instrument. In order to cause the filaments to freely protrude through the valve openings, it is advisable to push the member completely in and then withdraw it slightly so that the filaments will spring back to a radial position. With devices having a cap, it is advisable to work the member back and forth several times within the instrument. The ends of the filaments in contact with the moisture on the walls and key pads cause the moisture to transfer to the outside walls of the filaments by the process of adsorption. Where the filament is hollow or made from cotton, the moisture is also transferred to the filament by absorption. The moisture moves along the filament until it reaches the elongated absorbent member 14 on the elongated member. The moisture is trapped on the absorbent member and held there like a reservoir.

As long as the instrument is not enclosed in an airtight case, the member will tend to dry. Of course, drying will occur at a faster rate if the device is taken out of the instrument and left outside the case when the instrument is being played.

Periodically, the device may be washed and machine or sun dried to rejuvenate its freshness.

I claim:

1. A device for demoisturizing the inside walls and valve pads of a wind musical instrument having valve openings comprising:

a. an elongated semi-rigid member having a length selected to span a substantial portion of the sectional length of said instrument;

b. a plurality of filaments attached along a substantial portion of the length of said semi-rigid member and extending outwardly therefrom and having a length dimensioned to touch the inside walls of said instrument and to extend through the valve openings and touch said valve pads.

2. A device as described in claim 1 comprising:

a. an end cap connected to one end of said semi-rigid member adapted for registration with one end of said instrument and for centering said device within said instrument.

3. A device as described in claim 1 comprising:

a. said filament material is made from nylon.

4. A device as described in claim 1 comprising:

a. said filament material is made from a bulked continuous filament having voids running lengthwise through each filament.

5. A device as described in claim 1 comprising:

a. an elongated strip of moisture absorbent material connected to said elongated member and operatively connected to said filaments.

6. A device as described in claim 5 comprising:

a. said elongated member consists of a pair of wires, twisted to hold said filaments; and b. said absorbent material consists of a strip of woven cotton cloth intertwined with said wires.

7. A device as described in claim 1 comprising:

a. said plurality of filaments are made from a blend of a plurality of cotton fibers and a plurality of synthetic fibers.

8. A device as described in claim 1 comprising:

a. said length of said filaments and the arrangement on said elongated member is selected so as to form a taper to register with the taper of said instrument walls.

9. A device for demoisturizing the inside walls and valve pads of a wind musical instrument comprising:

a. an elongated semi-rigid member having a length selected to span a substantial number of said valve openings;

b. an elongated strip of moisture absorbent material connected to said elongated member;

c. a plurality of nylon and cotton filaments extending from said elongated member and operatively connected to said absorbent material and having a length dimensioned to touch the inside walls of said instrument and to extend through the valve openings and touch said valve pads; and d. an end cap connected to one end of said elongated member for registration with one end of said instrument and for centering said device within said instrument.

* * * * *